US009120145B2

(12) United States Patent
Ohira et al.

(10) Patent No.: US 9,120,145 B2
(45) Date of Patent: Sep. 1, 2015

(54) OIL TYPE RELEASE AGENT FOR METAL CASTING, SPRAY METHOD, AND ELECTROSTATIC SPRAY APPARATUS

(75) Inventors: Hirobumi Ohira, Tokyo (JP); Koji Togawa, Tokyo (JP); Daisuke Serino, Aichi-gun (JP); Kazuo Kato, Toyota (JP)

(73) Assignees: AOKI SCIENCE INSTITUTE CO., LTD., Tokyo (JP); TOYOTA JIDOSHA KABUSHIKI KAISHA, Toyota-Shi, Aichi (JP)

( * ) Notice: Subject to any disclaimer, the term of this patent is extended or adjusted under 35 U.S.C. 154(b) by 105 days.

(21) Appl. No.: 12/329,364

(22) Filed: Dec. 5, 2008

(65) Prior Publication Data

US 2009/0074981 A1 Mar. 19, 2009

Related U.S. Application Data

(63) Continuation of application No. PCT/JP2008/054817, filed on Mar. 14, 2008.

(30) Foreign Application Priority Data

Mar. 28, 2007 (JP) ..... 2007-085674

(51) Int. Cl.

| | |
|---|---|
| ***B22C 3/00*** | (2006.01) |
| ***B28B 7/38*** | (2006.01) |
| ***B22C 23/02*** | (2006.01) |
| ***C10M 169/04*** | (2006.01) |
| ***B28B 7/36*** | (2006.01) |
| ***B22D 17/20*** | (2006.01) |

(52) U.S. Cl.

CPC ..... *B22C 23/02* (2013.01); *B22D 17/2007* (2013.01); *B28B 7/36* (2013.01); *B28B 7/388* (2013.01); *C10M 169/04* (2013.01); *C10M 169/044* (2013.01); *C10M 2201/02* (2013.01); *C10M 2203/1006* (2013.01); *C10M 2207/289* (2013.01); *C10M 2219/044* (2013.01); *C10N 2220/022* (2013.01); *C10N 2240/58* (2013.01)

(58) Field of Classification Search

CPC ..... B22C 3/00; B28B 7/36; B28B 7/388; C10M 101/02; C10M 105/02; C10M 169/044; C10M 105/76; C10N 2220/022; C10N 2240/58

USPC ..... 106/38.24

See application file for complete search history.

(56) References Cited

U.S. PATENT DOCUMENTS

| | | | | |
|---|---|---|---|---|
| 7,143,812 | B2 * | 12/2006 | Bahaychick et al. | 164/472 |
| 2007/0131140 | A1 * | 6/2007 | Aoki et al. | 106/38.22 |

FOREIGN PATENT DOCUMENTS

| | | | |
|---|---|---|---|
| EP | 1134277 | A1 | 9/2001 |
| JP | 6142462 | | 2/1986 |
| JP | 61182519 | | 8/1986 |
| JP | 6-182519 | A | 7/1994 |
| JP | 9001309 | A | 1/1997 |
| JP | 9235496 | | 9/1997 |
| JP | 2000153217 | | 6/2000 |
| JP | 2001-259787 | A | 9/2001 |
| JP | 2005103626 | A | 4/2005 |
| WO | 99/47295 | A1 | 9/1999 |
| WO | 2006025368 | | 3/2006 |

OTHER PUBLICATIONS

Translation of Office Action for related Japanese Application No. 2008-535590 (notice date Jan. 27, 2011).

Search Report for related European Application No. 08722213.9, dated Jun. 8, 2012.

Search Report for related European Application No. 08722213.9, dated Jun. 15, 2012.

* cited by examiner

*Primary Examiner* — David M Brunsman

(74) *Attorney, Agent, or Firm* — Baker & Hostetler LLP

(57) ABSTRACT

There is disclosed an oil type release agent for metal casting includes 0-7.5% by mass of water consisting of one or two kinds of water selected from distilled water, ion-exchange kinds of water, tap water and water includes any one of aforementioned kinds of water and electrolyte(s) dissolved in any one of aforementioned kinds of water, and 0.3-30% by mass of a solubilizing agent, a spray method using the oil type release agent, and an electrostatic spray apparatus.

5 Claims, 2 Drawing Sheets

OIL TYPE RELEASE AGENT FOR METAL CASTING, SPRAY METHOD, AND ELECTROSTATIC SPRAY APPARATUS

CROSS REFERENCE TO RELATED APPLICATIONS

This is a Continuation Application of PCT Application No. PCT/JP2008/054817, filed Mar. 14, 2008, which was published under PCT Article 21(2) in Japanese.

This application is based upon and claims the benefit of priority from prior Japanese Patent Application No. 2007-085674, filed Mar. 28, 2007, the entire contents of which are incorporated herein by reference.

BACKGROUND OF THE INVENTION

1. Field of the Invention

This invention relates to an oil type release agent for metal casting which is designed to be used for the casting of non-ferrous metals such as aluminum, magnesium, zinc, etc., to a spray method using the oil type release agent, and to an electrostatic spray apparatus.

2. Description of the Related Art

As is well known, not less than 99% of release agents that have been used past 40 years for the casting of non-ferrous metals such as aluminum, magnesium, zinc, etc. have been occupied by water-soluble release agents. Meanwhile, oil type release agents, which make it possible to perform the casting of non-ferrous metals applying spray as low as 1/500-1/1000 times the amount required in the case of the water-soluble release agents, have begun to be used from three years ago. However, since the amount of oil type release agents to be sprayed is very little, the oil film to be adhered on a mold becomes insufficient sometimes, especially in the case of a complicated mold in configuration or a large mold in size. For example, in the case of the complicated mold in configuration, the formation of an oil film becomes especially insufficient at the portions of the mold which are hidden from the spraying direction. Additionally, since the mold is constituted by convex and concave portions, the release agent film tends to become thick at the concave portions.

Conversely, the release agent film tends to become thinner at the convex portions. Because of this, while the release agent is more likely to build up excessively at the concave portions, thereby giving rise to one of the causes for an increase of porosity, a soldering of a casting product may be caused to occur at the convex portions due to insufficiency of mold release film at the convex portions. In order to cope with this problem, currently, measures are taken to perform the casting by increasing the quantity of spray of release agent so as to enable the splashed particles thereof to sufficiently reach the hidden portions and the convex portions while sacrificing the increase in more or less of porosity. On the other hand, in the case of a large size mold, the thermal energy of a molten non-ferrous metal is large. Therefore, the temperature of the entire body of the mold, especially the temperature of thin-walled portions, is caused to rise approaching the temperature of the molten metal, thus increasing the temperature to 350° C. or more.

As a result, Leidenfrost's phenomenon may take place in an oil type release agent, thus allowing the droplets of release agent to boil. Further, due to this boiling, the droplets that splash from the mold onto the floor may be caused to increase. Because of this, the oil film to be formed would become thinner, thus possibly deteriorating the mold release characteristics. In order to cope with this problem, two different methods have been adopted. One of them is to spray a relatively large quantity of release agent, thereby increasing the thickness of the oil film. The other is to spray a small amount of water onto the thin-walled portions which become high temperatures to thereby cool the thin-walled portions, and then to spray an oil type release agent. When the release agent is sprayed in a relatively large quantity, the portions of mold where the oil film has already been formed to a sufficient thickness are also increased in thickness of the oil film. As a result, the quantity of porosity is more likely caused to increase in the cast product. Additionally, the strength of the cast product may sometimes be decreased slightly. In the latter method, conversely, even if the quantity of water to be applied is small, the installation of piping is required for spraying water.

As explained above, the conventional techniques are accompanied with the following problems. Namely, it is impossible to sufficiently feed a release agent to hidden portions of the mold, thereby making it impossible to form an appropriate oil film at such hidden portions. Further, it is impossible to form a uniform oil film at convex and concave portions, thereby necessitating the excessive spraying of release agent. Furthermore, it is impossible to form a satisfactory oil film at the thin-walled portions of the mold.

Under the circumstances, there have been conventionally proposed various kinds of modified techniques.

JP-A 6-182519 (KOKAI) (Patent Document 1) describes a technique wherein the droplets of release agent are negatively charged by making use of a spray apparatus and sprayed onto a mold which has been positively charged, thereby enabling the droplets of release agent to reach the hidden portions of mold. However, in the case of this technique, since the electrical conductivity of a water-soluble releasing agent is so high, it is impossible to decrease the electrical conductivity even if the quantity of water is reduced. Because of this, electrostatic spraying cannot be applied to any water-soluble releasing agents. Further, since the electric insulating properties of an oil type releasing agent are so high, electrostatic spraying cannot be applied to any oil type releasing agents either.

JP-A 2001-259787 (KOKAI) describes a technique similar to that of aforementioned Patent Document 1, and is directed to a technique using a water emulsion containing a large quantity of silicones. However, this technique cannot be applied to an oil type release agent.

JP-A 9-235496 (KOKAI) describes, as means for providing a paint with electrical conductivity, a technique for lowering the electric resistance through the use of alcohol or ammonium salt as an electrostatic assistant. JP-A 2000-153217 (KOKAI) describes a technique suggesting the addition of an electrostatic assistant to a paint. However, the "electrostatic assistant exhibiting strong chemical polarity" can be dissolved in the "oil type release agent exhibiting weak chemical polarity" at a ratio of only 0.3% by weight, thus generating sedimentation or separation. According to the studies made by the present applicant, it was found impossible to recognize the adhesion enhancing effects of the electrostatic assistant at such a low level. Although the solubility of the electrostatic assistant can be enhanced by the addition of polar solvents, the health of cast workers may be damaged by the addition of polar solvents. For this reason, i.e., taking the health of workers into consideration, no polar solvents are included in the composition of an oil type release agent.

Other conventionally known related arts include a technique wherein a high-temperature type release agent and a low-temperature type release agent are separately applied by means of electrostatic spraying as disclosed in JP-A 61-42462 (KOKAI), and a technique wherein an ultrasonic wave is employed, as disclosed in JP-A 61-182519 (KOKAI).

BRIEF SUMMARY OF THE INVENTION

An object of the present invention is to provide an oil type release agent for metal casting, a spray method using the oil type release agent, and an electrostatic spray apparatus, which make it possible to form an oil film having a sufficient thickness even at hidden, convex and thin-walled portions of a mold while avoiding excessive spraying of an oil type release agent at the concave portions of the mold.

1) With a view to achieve the aforementioned object, the oil type release agent for metal casting according to the present invention (the first invention) is characterized as having the following features of (a) and (b).

(a) 0-7.5% by mass of water consisting of one or two kinds of water selected from distilled water, ion-exchange water, tap water and water comprising any one of aforementioned kinds of water and electrolyte(s) dissolved therein;

(b) 0.3-30% by mass of solubilizing agents.

2) The spray method according to the present invention (the second invention) is characterized by a step of electrostatical spraying by making use of the oil type release agent which is defined by the aforementioned item 1).

3) The electrostatic spray apparatus according to the present invention (the third invention) is characterized by the installation of an electrostatic charge-applying device and of an electrostatic spray gun on a multi-axle robot for applying electrostatic spraying which is defined by the aforementioned item 2).

According to the present invention, it is now possible to form an oil film having a sufficient thickness even at hidden portions, convex/concave portions and thin-walled portions of a mold while avoiding excessive spraying of an oil type release agent at any portions of the mold. As a matter of fact, when a "composition comprising an oil type release agent mixed with a solubilizing agent containing dissolved water" is sprayed by making use of the electrostatic spray apparatus according to the present invention, the adhesion of releasing agent to the mold can be significantly enhanced. Especially, when the electrostatic spray gun is mounted on a multi-axle robot whose movement can be electrically controlled, the effects of electrostatic charging can be magnified.

DETAILED DESCRIPTION OF THE INVENTION

Figure 1:
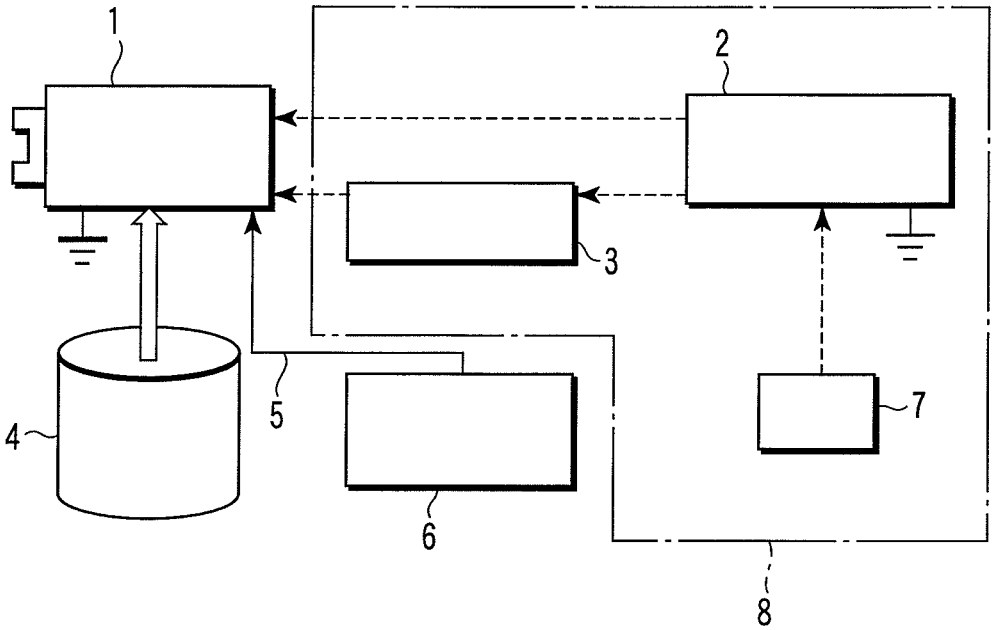
FIG. 1 is a diagram schematically illustrating the entire structure of the electrostatic spray apparatus according to one embodiment of the present invention.

Next, the present invention will be further explained in detail.

The aforementioned conventional oil type release agent does not contain water and is formed of solvents or base oils, which are constituted by petroleum saturated hydrocarbon having low in polarity. As for the additives for the oil type release agent, they include lubricating additives such as silicones, vegetable oils, etc., and high-viscosity petroleum hydrocarbon oils for maintaining the oil film. As examples, conventional oil type release agents can be listed such as release agents including so called "start-up agents" those disclosed in PCT/JP2005/015737 which is equivalent to US 2007/0131140 and is incorporated herein by reference. PCT/JP2005/015737 and its equivalent US 2007/0131140 disclose an oil type release agent for die casting containing (a) 70 to 98 parts by weight of solvents having a dynamic viscosity of 2 to 10 $mm^2/s$ at 40.degree° C. and the flash point in the range of 70 to 170° C.; (b) 1 to 10 parts by weight of the mineral oils and/or synthetic oils having dynamic viscosity of 100 $mm^2/s$ or higher at 40° C.; (c) 15 parts by weight or less of a silicone oil having dynamic viscosity of 150 $mm^2/s$ or higher at 40° C.; and (d) 1 to 5 parts by weight of additives having a lubricating function, wherein the flash point of the agent is in the range of 70 to 170° C., and dynamic viscosity of the agent is 2 to 30 $mm^2/s$ at 40° C.

Since the oil type release agents of this kind are infinite in electric resistance, they are considered unsuitable for use in electrostatic spraying. In the industrial field of painting, it is known as an empirical value that if the electric resistance is regulated to the range of 5-50 MΩ, electrostatic spraying can be easily performed. For example, when water is dissolved in an oil type release agent at a ratio of 0.8% by mass with the help of solubilizing agents, the electric resistance can be lowered to about 20 MΩ. In the oil type release agent of the present invention, as described above, it is indispensable to incorporate therein 0-7.5% by mass of water consisting of one or two kinds of water selected from (a) distilled water, (b) ion-exchange water, (c) tap water and (d) water comprising any one of aforementioned kinds of water and a small amount of electrolyte(s) mixed with any one of aforementioned kinds of water. The reasons for this will be explained as follows.

Namely, if the water exceeds 7.5% by mass, the separation of water from an oil type release agent may be caused to occur, resulting in an increase in electric resistance or sometimes resulting in an infinite electric resistance, depending on the magnitude of separation. For this reason, 7.5% by mass of water is set as the upper limit in the present invention. On the other hand, if the amount of water is 0% by mass, the needle of ohm-meter would be scarcely reacted with the release agent, resulting in an infinite electric resistance.

It has been tried by the present inventors to perform the electrostatic spraying of an oil type release agent under the condition wherein the electric resistance was set to a level close to infinity, exceeding 50 MΩ, which is an empirical upper limit of electric resistance as admitted in the technical field of painting. As a result, there was recognized an increase of adhesion of releasing agent due to electrostatic effects as explained below. The reason for this may be ascribed to the following facts. Generally speaking, while the electric resistance in a beaker is measured with a dry battery of 1.5 volts, the voltage in the adhesion test where static electricity exists is 60 kV, which is 40,000 times as high as that of the dry battery. For this reason, it was assumed that, even if the electric resistance in the beaker was close to infinity, electrostatic effects were caused to develop with the application of an electrostatic spray gun of an actual machine. Namely, it can be said that the range of electric resistance which is required for the releasing agent is wider than the empirical range recognized in the technical field of painting.

In the present invention, each type of water as defined by aforementioned items (a), (b), (c) and (d) is capable of exhibiting a response in electric resistance which is faster in responding speed in the mentioned order as it is measured using the ohm-meter. However, the quantity of water that is needed for regulating the electric resistance required for the electrostatic spraying can be hardly influenced by this responding speed. Namely, although the responding speed can be increased by dissolving an electrolyte in water, the quantity of water that is needed for reducing the electric resistance may not be required to be changed substantially. Moreover, when the electrolyte such as caustic potash is mixed with water, there is a high possibility that the emulsification of the release agent itself may be promoted and that the solubilizing agent may be changed into an emulsifying agent. In view of the responding properties and emulsifying property, tap water was selected in the following examples. However, the selection of tap water is not intended to attach importance to the quality of the water.

In order to dissolve or solubilize water in the oil type release agent in the present invention, it may be conceivable to select solvents such as alcohol, glycol, ester, ether, ketone, emulsifying agents, etc. However, unless a solvent in which water has been dissolved can be further suitably dissolved in the petroleum hydrocarbon oil, the water as well as the solvent for water may be partially separated, thus possibly generating haziness. As a result, the electric resistance of the release agent may also become infinite. The properties for solubilization which the solvent for water is required to have are capabilities to enable water to be dissolved therein and to allow the solvent for water itself to be dissolved in a petroleum-based release agent having lower polarity. Although lower alcohols of C1 or C2 class or glycols are capable of dissolving water therein, they are more likely to be separated in a petroleum-based oil type release agent, thus rendering them unsuitable for use as a solubilizing agent.

Further, since the oil type release agent is designed to be sprayed in the application thereof, the solvent for water to be contained therein is required, as the characteristics thereof, to be low in toxicity so as not to adversely influence the health of workers, and also be low in polarity. In this aspect, the selection of ether or ketone which can be easily vaporized is undesirable. It is also important for the solvent for water to be almost odorless, so the lower alcohols of C3, C4 or C5 class are also undesirable for use. Although esters are excellent in mixing properties with an oil type release agent having low polarity, there is the possibility that esters may damage the health of casting workers. Taking these problems into consideration, it is preferable, for the purpose of dissolving water in an oil type release agent having low polarity, to select a nonionic solubilizing agent having not only a hydrophilic group but also a lipophilic group in the present invention.

Among such nonionic solubilizing agents, it is most preferable to select, as a solubilizing agent, one of which the HLB (Hydrophile-Lipophile Balance) is confined within the range of 5-10. If the HLB of solubilizing agent is less than 5, the solubilizing agent is not capable of dissolving water but can be easily dissolved in oil. Because of this, a large quantity of solubilizing agent may be required to be used in order to enable a predetermined quantity of water to be dissolved in an oil type release agent. If the HLB of solubilizing agent is higher than 10, the solubilizing agent may easily dissolve water but the solubilizing agent will not be dissolved in oil.

Therefore, when it is attempted to dissolve a predetermined quantity of water into an oil type release agent, the solubilizing agent is caused to separate. The solubilizing agent should most preferably be selected from those exhibiting a suitable range of HLB. As for the type of emulsifying agent, it is more preferable to select sorbitan type emulsifying agents which are irrelevant to or free from the problem of environmental hormones, rather than phenol/ether type chemicals, which may be connected to the problem of environmental hormones.

The blend of a solubilizing agent in an oil type release agent may deteriorate the mold-releasing property which the oil type release agent inherently has and, at the same time, may magnify the problem of porosity. In order to suppress these problems as much as possible, it is important to lower the mixing ratio of the solubilizing agent as much as possible. Specifically, the quantity of the solubilizing agent should preferably be not more than 9 times as large as the content of water.

Next, specific examples of the present invention will be explained together with comparative examples.

Example 1

First of all, the electrostatic spray apparatus according to Example 1 of the present invention will be explained with reference to FIGS. 1 and 2. Herein, FIG. 1 is a diagram schematically illustrating the entire structure of the electrostatic spray apparatus and FIG. 2 is an enlarged view of a portion of the electrostatic spray apparatus.

This electrostatic spray apparatus is equipped with an electrostatic spray gun 1, an electrostatic controller 2 which is electrically connected with the electrostatic spray gun 1, and a transformer 3 which is also electrically connected with the electrostatic spray gun 1. Additionally, this electrostatic spray apparatus is further equipped with a forced liquid-delivering device 4 for forcedly delivering an oil type release agent to the electrostatic spray gun 1, a compressor 6 for feeding air via a piping 5 to the electrostatic spray gun 1, and a power source (AC200V or 100V) 7 for driving the electrostatic controller 2. A static electrification apparatus 8 is constituted by the electrostatic controller 2, the transformer 3 and the power source 7. Electric signals from the transformer 3 are transmitted to the electrostatic spray gun 1. The oil type release agent is forcedly delivered to the electrostatic spray gun 1 by making use of the forced liquid-delivering device 4, and mixed with air and atomized in the electrostatic spray gun 1. By harmonizing the timing of spray with the timing of applying the electrification, the atomized oil type release agent can be sprayed onto a mold under the condition where the oil type release agent is electrostatically charged.

As for the electrostatic spray gun 1, EAB90 (Asahi Sunac Co., Ltd.) was used. Further, as for the static electrification apparatus 8, EPS210 (Asahi Sunac Co., Ltd.) was used. As for the forced liquid-delivering device 4, an assembled body consisting of a K-pump (0.5 mL type) (Ransburg Co., Ltd.) and BHI62ST-18 (Oriental Motor Co., Ltd.) was used.

Figure 2:
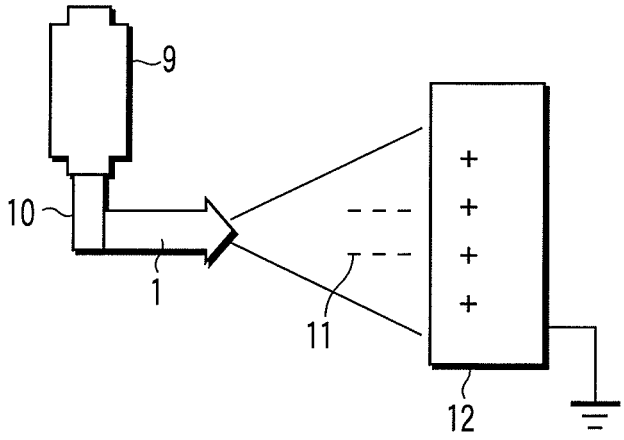
FIG. 2 is an enlarged view of a portion of the electrostatic spray apparatus shown in FIG. 1.

The multi-axle robot 9 shown in FIG. 2 was mounted on a casting machine (not shown there). The electrostatic spray gun 1 was secured through this multi-axle robot 9 on a bracket 10. The oil droplet 11, which was atomized by means of the electrostatic spray gun 1 and electrostatically negatively charged, was sprayed onto a mold 12 which was positively charged as shown in FIG. 2. The mold 12 was grounded.

As described above, the electrostatic spray apparatus of Example 1 was constituted by the static electrification apparatus 8 comprising the electrostatic controller 2, the transformer 3 and the power source 7; and the electrostatic spray gun 1 mounted on the multi-axle robot 9. According to this structure, since the electrostatic field is generated so as to enable it to wraparound the mold 12, the oil droplet 11 that has been negatively charged can be sprayed along this electrostatic field. Accordingly, the portions of the mold, to which the electrostatic spray gun 1 is not directly pointed (for example, the rear side of mold), can also be uniformly sprayed with an oil type release agent.

Examples 2-26 and Comparative Examples 1-19

Next, the oil type release agent for die casting according to the present invention and comparative examples will be explained. Incidentally, in these examples and comparative examples, the compositions wherein water was solubilized in WFR-3R, i.e., an oil type release agent manufactured by the present inventors, were employed as examples.

(A) Manufacturing Method:

First of all, a predetermined quantity of solubilizing agent was introduced into a stainless steel mixing tank which was equipped with a stirrer and capable of being heated to a temperature of 40° C. Then, a predetermined quantity of tap water was introduced into the mixing tank and the two liquids were stirred for 10 minutes. Thereafter, a predetermined quantity of the oil type release agent was added to the mixture and heated up to the temperature of 40° C. with stirring and then the stirring was further continued for 10 minutes. Finally, the transparency of the mixture in appearance was confirmed.

(B) Compositions of Samples:

The samples were formed of the following compositions.

WFR-3R: An oil type release agent manufactured by one of the present applicants;

Water: Tap water obtained from water supply available to the present applicant and having a hardness of about 30;

Solubilizing agent: One of the following two kinds ((a) or (b)) of solubilizing agent.

(a) A solubilizing agent consisted of a single composition: A sorbitan type solubilizing agent (available from Takemoto Yushi Co., Ltd.; Product name: D-212. This solubilizing agent was used in Examples 2-15 and Comparative Examples 1-11 (see Tables 3, 6 and 8 shown below))

(b) A mixture type solubilizing agent: The mixture (available from Takemoto Yushi Co., Ltd.; Product name: New Kalgen 140) comprising alcohol-based nonion, sorbitan monooleate and metallic salt of alkylbenzene sulfonic acid (Calcium salt). This mixture type solubilizing agent is higher in water-solubilization capacity as compared with the one-component type solubilizing agent. This mixture type solubilizing agent was used in Examples 16-26 and Comparative Examples 12-19 shown in Tables 4 and 5 to be explained hereinafter.

However, in Comparative Examples 2, an electrostatic assistant agent (available from BYK Co., Ltd.; product name: ES-80) was formulated instead of the solubilizing agent.

(C) Method for Measuring Electric Resistance (Based on ASTM D5682):

A sample of releasing agent (about 50 mL) was taken up in a 100 mL beaker to measure its electric resistance by making use of an electrostatic tester (available from Asahi Sunac; type: EM-III). Incidentally, since the electric resistance indicator needle was unstable at a region where the value measured was high, each of reported value was determined from an average value of five repeated measurements.

(D) Method for Measuring the Quantity of Adhesion:

(D-1) Preparation:

An iron plate used as a test piece is pre-baked in an oven for 30 minutes at the temperature of 200° C. Thereafter, the iron plate was left to cool overnight in a desiccator and the mass of the iron plate was measured to an accuracy of 0.1 mg.

Figure 3:
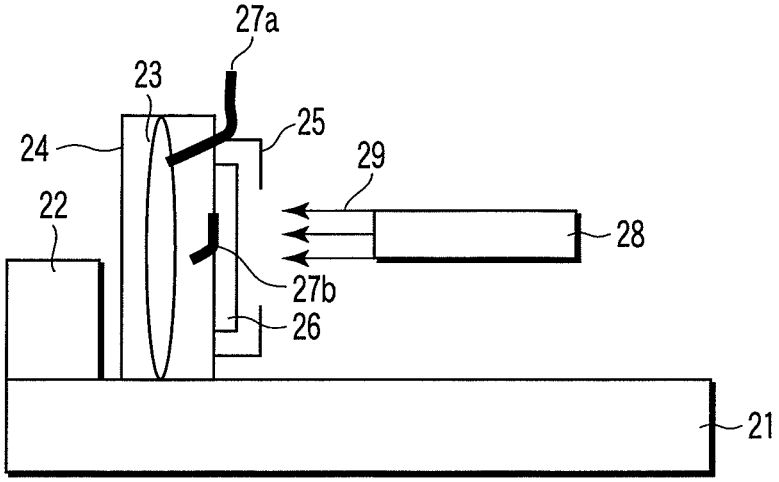
FIG. 3 is a diagram schematically illustrating a measuring apparatus which is designed to measure the amount of adhesion of an oil type release agent to a mold.

(D-2) Spraying of an Oil Type Release Agent:

FIG. 3 shows a spray apparatus for measuring the quantity of adhesion. The reference number 21 in FIG. 3 indicates the table of the adhesion testing machine. A power source/temperature regulator 22 is mounted on a portion of this table 21. An iron trestle 24 having a heater 23 inside is mounted on the table 21 and close to the power source/temperature regulator 22. An iron plate-supporting fitment 25 is secured to one side wall of the iron trestle 24. A test piece (iron plate) 26 is positioned inside the iron plate-supporting fitment 25. Two thermocouples, 27*a* and 27*b*, are buried in the vicinity of the heater 23 and the thermocouple 27*b* is contacted with the iron plate 26. It is designed that a release agent 29 is sprayed from a spray nozzle 28 toward the iron plate 26.

The operation of the spray apparatus shown in FIG. 3 can be performed as explained below.

First of all, the power source/temperature regulator 22 of the spray apparatus (Yamaguchi Giken Co., Ltd.) is set to a predetermined temperature and the iron plate-supporting fitment 25 is heated by means of the heater 23. When the thermocouple 27*a* is heated up to a set temperature, the iron plate 26 used as a test piece is placed on the iron plate-supporting fitment 25 and the thermocouple 27*b* is contacted steadily with the iron plate 26. Subsequently, when the temperature of iron plate 26 is reached to a predetermined temperature, a predetermined quantity of the release agent 29 is sprayed from the spray nozzle 28 toward the iron plate 26. Thereafter, the iron plate 26 is picked up, erected vertically and allowed to cool in an air atmosphere for a predetermined period of time. The oil components that flow down from the iron plate 26 are squeezed away.

(D-3) Method for Measuring the Quantity of Adhesion:

The iron plate 26 with adhered matter thereon is placed in the oven at a predetermined temperature and for a predetermined period of time. Thereafter, the iron plate 26 is picked up and air-cooled and further allowed to cool for a predetermined period of time in a desiccator. Thereafter, the mass of iron plate 26 with adhered matter thereon is measured to an accuracy of 0.1 mg and the quantity of adhered matter is calculated based on the blank test and a change in mass of the test piece.

(D-4) Test Conditions:

The test conditions in Examples 2-15 and Comparative Examples 1-11 are shown in the following Table 1. Further, although the test conditions in Examples 16-26 and Comparative Examples 12-19 shown in Tables 4 and 5 to be described hereinafter were fundamentally the same as those of Table 1, they differ from the test conditions of Table 1 in the respects that the air pressure was set to 0.05 MPa and the quantity of spray was set to 0.3 cc. Namely, the angle of spray gun, the period of spray, the voltage charged, and the drying condition for the iron plate after the test were the same as those shown in the following Table 1.

TABLE 1

| Parameters | Conditions |
|---|---|
| Angle of spray gun | 90 |
| Quantity of spray (mL) | 0.5 |
| Time period of spray (second) | 1 |
| Voltage applied (KV) | 60 |
| Air pressure (MPa) | 0.3 |
| Distance of spray gun (mm) | 200 |
| Temp. of iron plate (° C.) | 250 |
| Drying of iron plate after test | 200° C., 30 min. |

Figure 4A:
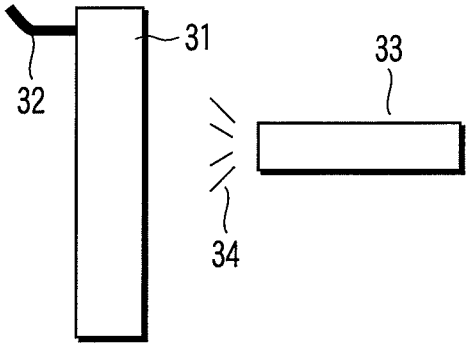
FIG. 4A is a diagram schematically illustrating a state wherein a release agent is sprayed from a spray nozzle to an iron plate for friction-measurement.
Figure 4B:
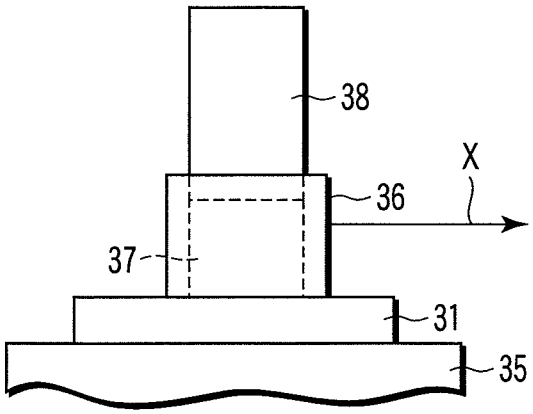
FIG. 4B is a diagram schematically illustrating a state wherein the frictional force of an aluminum piece which is solidified inside a ring mounted through the friction-measuring iron plate on a test machine table is measured while pulling the ring in one direction.

(E) Method for Measuring the Frictional Force:

(E-1) Method of Testing the Friction:

FIGS. 4A and 4B illustrate the order of steps in the method of measuring the frictional force of the test piece. The operating method of the friction test is as follows. An iron plate (SKD-61; 200 mm×200 mm×34 mm) 31 for measuring the friction of an automatic tension tester (MEC International Co., Ltd.) is equipped with a built-in thermocouple 32. This iron plate 31 is heated by making use of a heater which is available in the market. When this thermocouple 32 is actuated to indicate a predetermined temperature, the iron plate 31 for measuring the friction is erected vertically. Then, under the conditions described in the aforementioned adhesion test, a release agent 34 is sprayed from a spray nozzle 33.

Then, the iron plate 31 for measuring the friction is immediately placed horizontally on a tester trestle 35 as shown in FIG. 4B. Further, a ring (MEC International Co., Ltd.; S45C; 75 mm in inner diameter, 100 mm in outer diameter and 50 mm in height) 36 is placed on a central portion of the iron plate 31. Then, 90 mL of molten aluminum (ADC-12; temperature: 670° C.) 37, which has been melted in advance in a fusion furnace for ceramics, are poured in the ring 36. Subsequently, the molten aluminum 37 is allowed to cool in an air atmosphere for 40 seconds and to solidify. Immediately thereafter, an iron weight having a weight of 8.8 kg (a total weight thereof together with the molten aluminum is 10 kg) is gently placed on this solidified aluminum (ADC-12) and then the ring 36 is pulled in the direction of X indicated by an arrow to thereby measure the frictional force of the solidified aluminum.

(E-2) Conditions for Measuring the Frictional Force:

The conditions for the spraying are the same as those of Table 1. The conditions for measuring the frictional force are as shown in the following Table 2.

TABLE 2

| | |
|---|---|
| Load | 10 Kg<br>(Total of ring, Al and weight) |
| Contacting area | 44.2 $cm^2$<br>(Cross-sectional area of ring) |
| Pulling speed | 1 cm/sec |

(F) Method for Measuring Leidenfrost's Temperature:

First of all, an iron plate to be used in the aforementioned adhesion test is placed on an electric hot plate which is available in the market and then heated. Thereafter, the surface temperature of the iron plate is measured by making use of a non-contact type thermometer. Then, when this surface temperature reaches 400° C., one droplet (about 0.1 mL) of the release agent is dropped from a pipette. Then, the state of the droplet immediately after the dropping thereof is observed and then any of the following operations 1), 2), or 3) is performed.

1) When the droplet is rolled or moved over the iron plate, the aforementioned surface temperature is raised up additionally by 5° C. and the test is tried again.

2) When the droplet jumps, the aforementioned surface temperature is lowered by 5° C. and the test is tried again.

3) The boiling temperature under the condition wherein the movement of the droplet is relatively gentle, or in an intermediate state between the aforementioned items 1) and 2), is then found. The temperature obtained in this manner is determined as being Leidenfrost's temperature.

(G) Method for Measuring Viscosity:

The measurement of viscosity is based on JIS-K-2283.

(H) Components and the Results of Measurements in the Tests:

(H-1) Results of Measurement-1: Electric Resistance:

The following Table 3 illustrates the compositions and the results measured of electric resistance with respect to Examples 2-5 and Comparative Examples 1-2 which are related to single composition type solubilizing agent systems. The following Tables 4 and 5 summarize the results measured with respect to the compositions, adhesion characteristics, appearance, electric resistance, viscosity at 40° C. and Leidenfrost's temperature of Examples 16-26 and Comparative Examples 12-19 which are related to mixture type solubilizing agents.

TABLE 3

| | Comp. mass % | | | | Results of measurement | |
|---|---|---|---|---|---|---|
| | WFR-3R | Tap water | Solubilizing agent | Electro static assistant | Resistance (MΩ) | Appearance of liquid |
| Ex. 2 | 94.0 | 1.2 | 4.8 | | 7 | Slightly hazy |
| Ex. 3 | 95.0 | 1.0 | 4.0 | | 20 | Transparent |
| Ex. 4 | 98.0 | 0.4 | 1.6 | | 200: Unstable | Transparent |
| Ex. 5 | 99.0 | 0.2 | 0.8 | | 500: Unstable | Transparent |
| Comp. Ex. 1 | 100 | 0 | 0 | | Infinite | Transparent |
| Comp. Ex. 2 | 99.7 | 0 | 0 | 0.3 | Infinite | Slightly hazy |

TABLE 4

| | Water (mass %) | Solubilizing agent (mass %) | Quantity of adhesion with static electrification (mg) | Quantity of adhesion without static electrification (mg) | Increase in adhesion owing to static electrification (mg) |
|---|---|---|---|---|---|
| Comp. Ex. 12 | 0 | 0 | — | 19.4 | Standard |
| Comp. Ex. 13 | 0 | 0 | 23.5 | — | 3.9 |
| Comp. Ex. 14 | 0.1 | 0.23 | 23.4 | 20 | 3.4 |
| Ex. 16 | 0.1 | 0.4 | 23.5 | 19.4 | 4.1 |
| Comp. Ex. 15 | 0.1 | 0 | — | — | — |
| Ex. 17 | 0 | 1 | 24.3 | 20.7 | 3.7 |

TABLE 4-continued

| | Water (mass %) | Solubilizing agent (mass %) | Quantity of adhesion with static electrification (mg) | Quantity of adhesion without static electrification (mg) | Increase in adhesion owing to static electrification (mg) |
|---|---|---|---|---|---|
| Ex. 18 | 0.4 | 1.6 | 25.3 | 20.8 | 4.5 |
| Ex. 19 | 1 | 4 | — | — | — |
| Ex. 20 | 1.2 | 4.8 | 30.2 | 23.7 | 6.5 |
| Ex. 21 | 0 | 5 | 28.4 | 22.9 | 5.5 |
| Ex. 22 | 2 | 8 | — | — | — |
| Ex. 23 | 3 | 12 | — | — | — |
| Ex. 24 | 4.3 | 10 | 33.4 | 27.6 | 5.8 |
| Ex. 25 | 0 | 10 | 35.5 | 29.9 | 5.6 |
| Ex. 26 | 7.5 | 30 | 64.5 | 54.1 | 10.4 |
| Comp. Ex. 16 | 12.9 | 30 | 66.0 | 62.1 | 3.9 |
| Comp. Ex. 17 | 12.5 | 50 | 79.6 | 74 | 5.6 |
| Comp. Ex. 18 | 21.5 | 50 | 70.8 | 63.8 | 7.0 |
| Comp. Ex. 19 | 0 | 50 | 92.7 | 76.7 | 16.0 |

TABLE 5

| | Appearance/state | Resistance (MΩ) | Viscosity at 40° C. ($mm^2/S$) | LF point (° C.) |
|---|---|---|---|---|
| Comp. Ex. 12 | Transparent | ∞ | — | — |
| Comp. Ex. 13 | Transparent | ∞ | — | — |
| Comp. Ex. 14 | Slight hazy | ∞ | — | — |
| Ex. 16 | Transparent | ∞ | — | — |
| Comp. Ex. 15 | Separation | ∞ | — | — |
| Ex. 17 | Transparent | ∞ | 4.4 | 465 |
| Ex. 18 | Transparent | 380 | — | 440 |
| Ex. 19 | Transparent | 180 | — | 430 |
| Ex. 20 | Transparent | 115 | — | — |
| Ex. 21 | Transparent | 570 | 4.8 | 465 |
| Ex. 22 | Transparent | 72 | — | 400 |
| Ex. 23 | Transparent | 47 | — | 385 |
| Ex. 24 | Transparent | 58 | 5.9 | 375 |
| Ex. 25 | Transparent | 270 | 5.4 | 465 |
| Ex. 26 | Transparent | 13 | 13.3 | 365 |
| Comp. Ex. 16 | Emulsification | 21 | 16.9 | 345 |
| Comp. Ex. 17 | Transparent | 3.2 | 46 | 330 |
| Comp. Ex. 18 | Emulsification | 6.2 | 98 | 310 |
| Comp. Ex. 19 | Transparent | 13 | 21.6 | 510 |

As indicated by Comparative Example 1 (water: 0% by mass), Example 5 (water: 0.2% by mass), Example 4 (water: 0.4% by mass), Example 3 (water: 1.0% by mass) and Example 2 (water: 1.2% by mass) in above Table 3, when the water content was increased in the oil type release agent, the electric resistance was decreased correspondingly. The reason for this may be ascribed to the use of the single solubilizing agent D-212. For the purpose of confirmation, the assessment was performed by making use of a mixture type solubilizing agent of New Kalgen 140.

Example 17 (water: 0% by mass) exhibited an infinite electric resistance as shown in Tables 4 and 5. Whereas, the electric resistance of Example 18 (water: 0.4% by mass), Example 19 (water: 1% by mass), Example 20 (water: 1.2% by mass), Example 22 (water: 2% by mass), Example 23 (water: 3% by mass), Example 24 (water: 4.3% by mass) and Example 26 (water: 7.5% by mass) was 380 MΩ, 180 MΩ, 115 MΩ, 72 MΩ, 47 MΩ, 58 MΩ and 13 MΩ, respectively. As seen from these results, as the mixing ratio of water is increased, the electric resistance tends to decrease. Namely, not only the single system solubilizing agent but also the mixture system solubilizing agent indicate the tendency that as the mixing ratio of water is increased, the electric resistance is caused to decrease.

However, in the case of Comparative Example 14 (water: 0.1% by mass; and solubilizing agent: 0.23% by mass), haziness was somewhat caused to generate. This indicates that at least 2.3 parts of solubilizing agent is required for one part of water. If it is desired to increase the content of water higher than this, an increased quantity of solubilizing agent is required to be mixed therewith as shown in Example 2, Example 20 and Example 26.

As shown by Comparative Example 2 in Table 3, since it was impossible to enable the electrostatic assistant agent to dissolve in the oil type release agent at a ratio exceeding 0.3% by mass, the electric resistance thereof was measured at 0.3% by mass. However, the measured value was infinite. It was assumed that since the electrostatic assistant agent could not be dissolved sufficiently in the oil type release agent, only lower electrostatic effects could be expected.

Incidentally, above Table 4 indicates not only the mixing ratio of water and the solubilizing agent, which were components in the oil type release agent for die casting according to Examples 16-26 and Comparative Examples 12-19, but also the quantity of adhesion in the case of the existence or non-existence of static electrification, as well as the amount increase of adhesion (lubricating components; i.e. a high-viscosity base oil component, three kinds of lubricating components and a solubilizing agent in the oil type release agent) due to static electrification. Additionally, Table 5 illustrates the appearance/state, viscosity at 40° C. and Leidenfrost's temperature (LF point) of oil type release agents for metal casting according to Examples 16-26 and Comparative Examples 12-19.

(H-2) Results of Measurement-2: Effects of Water Content:

As described in the aforementioned item (H-1), as the content of water is increased, the electric resistance is caused to decrease correspondingly, thus realizing the electrostatic effects. However, it is required to solubilize the water in an oil type release agent by making use of a solubilizing agent. However, in order to minimize the possibility of side-effects due to water and the solubilizing agent on the mold-releasing properties, it is necessary to optimize the content of water as well as the content of the solubilizing agent.

First of all, the lower limit in content of water will be explained.

In the case of using the solubilizing agent D-212 which was constituted by a single component, when the electrostatic spraying was applied by making use of 0.4% by mass of water (Example 4) and by making use of 0.2% by mass of water (Example 5), the quantity of adhesion was increased by about 2 mg, respectively. On the other hand, when the electrostatic spraying was performed by making use of 0.3% by mass of an electrostatic assistant without incorporating water therein (Comparative Example 2), the electrostatic effects could not be recognized. It has been generally recommended, by makers of electrostatic assistants, to incorporate 0.5%-1.0% by mass of an electrostatic assistant in a releasing agent. The reason for this was assumably ascribed to the fact that, since it was impossible to dissolve the electrostatic assistant in the oil type release agent so much, it was not able to obtain the electrostatic effects.

In the case of using the mixture type solubilizing agent of New Kalgen 140, it was found out from the comparison between Comparative Example 12 (water: 0 and solubilizing agent: 0), where the static electrification was not utilized, and Comparative Example 13, where the static electrification was utilized, that even if the content of water was zero, it was possible to further increase the quantity of adhesion, as seen from Comparative Example 13. Namely, it was confirmed that when static electrification existed, the quantity of adhesion was increased. However, it will be recognized from the comparison between Comparative Example 13 (water: 0 and solubilizing agent: 0), where the static electrification was utilized, and Example 17, where water was not included therein, that the magnitude of increase in adhesion due to static electrification in Example 17, where a solubilizing agent was utilized even though water was not contained at all, was almost the same as that of Comparative Example 13. Further, it was found out through comparing Comparative Example 13 by Examples 21 and 25 where a solubilizing agent was contained therein even though water was not included therein that the increase in magnitude of adhesion due to static electrification was more prominent in Examples 21 and 25 as compared with Comparative Example 13. It was also found out that the use of a solubilizing agent having polarity was effective in increasing the adhesion.

Namely, if the single composition type solubilizing agent D-212 is to be used, the lower limit in content of water is 0.2% by mass. On the other hand, if the mixture type solubilizing agent New Kalgen 140 is to be used, the lower limit in content of water is 0% by mass. Therefore, it can be said that the lower limit in content of water is 0% by mass.

ognized but there was also recognized emulsification. However, Example 24 (water: 4.3% by mass) and Example 26 (water: 7.5% by mass) were found free from the emulsification problem, and the electric resistance value thereof was 58 MΩ and 13 MΩ, respectively, both falling within the range suitable for the electrostatic spraying. Further, in Example 24 and Example 26, the viscosity at 40° C. was 5.9 $mm^2/s$ and 13.3 $mm^2/s$, respectively, thus confirming that the release agents thereof were not viscous and easy to spray. Namely, the upper content of water was considered as being 7.5% by mass.

Further, the upper limit for water content in practical viewpoint in metal casting will be explained.

If the water content is too high, the practical performance of the release agent may be deteriorated. Namely, the water may be suddenly boiled up as the release agent is sprayed onto a mold heated to high temperatures, thereby covering the surface of the mold with a film of steam. As a result, it may become difficult to enable the mist of the releasing agent that has been sprayed to reach the surface of the mold. For this reason, the adhesion efficiency of the releasing agent is caused to deteriorate sharply. This phenomenon is called Leidenfrost's phenomenon. As shown in Examples 18, 19, 22, 23, 24 and 26 of Tables 4 and 5, as the content (% by mass) of water was increased, the Leidenfrost temperature (LF point) was apparently caused to drop, i.e. 440° C., 430° C., 400° C., 385° C., 375° C., 365° C., respectively. The Leidenfrost temperatures in all of these examples were satisfactory, i.e., not lower than 350° C., which is far higher than the LF point of the water-soluble releasing agent, which is about 250° C. However, when the temperature of the mold is higher than 400° C., the problem of adhesion may occur occasionally. Therefore, a preferable range of water content should be 2% by mass, which corresponds to 400° C. in LF point. Namely, from a practical viewpoint, the preferable range of water content should be confined to not more than 2% by mass.

TABLE 6

| | Comp.: mass % | | | | Quantity of adhesion (mg) | Quantity of adhesion (mg) | Increase in adhesion (mg) |
|---|---|---|---|---|---|---|---|
| | WFR-3R | Tap water | Solubilizing agent | Electro static assistant | With electrification | Without electrification | Effects of static electrification |
| Ex. 4 | 98.0 | 0.4 | 1.6 | 0 | 18.5 | 16.4 | 2.1 |
| Ex. 5 | 99.0 | 0.2 | 0.8 | 0 | 18.2 | 15.9 | 2.3 |
| Comp. Ex. 1 | 100 | 0 | 0 | 0 | — | 16.3 | 0 |
| Comp. Ex. 2 | 99.7 | 0 | 0 | 0.3 | 14.4 | 16.3 | 1.9 |

Next, the upper limit in content of water will be explained.

In the case of using the solubilizing agent D-212 which was constituted by a single component, although the appearance obtained in Example 3 (water: 1.0% by mass) was transparent, haziness was recognized in Example 2 (water: 1.2% by mass) to some extent and hence 1.2% by mass was considered as the upper limit of water content.

On the other hand, in the case where the mixture type solubilizing agent New Kalgen 140 was used, the increase in adhesion due to static electrification was recognized, as seen from Example 20 (water: 1.2% by mass), Example 24 (water: 4.3% by mass) and Example 26 (water: 7.5% by mass) shown in Table 4. Further, in the cases of Comparative Example 16 (water: 12.9% by mass) and Comparative Example 18 (water: 21.5% by mass) where the water content was relatively high, the increase in adhesion due to static electrification was rec- (H-3) Results of Measurement-3: Electrostatic Effects:

As described in the aforementioned item (H-2), although it is possible to blend a large quantity of water, it requires the utilization of a solubilizing agent. In fact, as shown in Example 26 in Table 4, it is possible to blend a solubilizing agent at a ratio of 30% by mass. However, if a large quantity of solubilizing agent is utilized, a side-effect, i.e. an increase of porosity in the casting products, may be caused to generate. Therefore, the electrostatic effects under the conditions, where the spray conditions were varied, were investigated using Example 4 composition (1.6% by mass of solubilizing agent; 0.4% by mass of water; 200 MΩ in electric resistance), where the quantity of solubilizing agent was relatively small. The test conditions are shown in the following Table 7.

TABLE 7

| | Conditions | Remarks |
|---|---|---|
| Water in sample: mass % | 0, 0.4 | Two levels |
| Angle of spray gun | 90 | Fixed |
| Quantity of spray (mL) | 0.5 | Fixed |
| Time period of spray (second) | 1 | Fixed |
| Voltage applied (KV) | 0, 60 | Two levels |
| Air pressure (MPa) | 0.2, 0.3, 0.4 | Three levels |
| Distance of spray gun (mm) | 150, 200, 250 | Three levels |
| Temp. of iron plate (° C.) | 150, 250, 350 | Three levels |

The results obtained are shown in the following Table 8. Table 8 shows the measurement results of the quantity of adhesion and frictional force in order to investigate the "effects of the existence or non-existence of static electrification" as the test conditions (spray air pressure, spraying distance, temperature of iron plate and the existence or non-existence of static electrification) were varied. Further, the compositions of Examples 6-14 and Comparative Examples 3-11 in Table 8 were the same as those of Example 4 (i.e. WFR-3R: 98.0% by mass, tap water: 0.4% by mass, solubilizing agent D-212: 1.6% by mass).

examples which were checked with the "existence of static electrification" as compared with those checked with the "non-existence of static electrification" as seen from Examples 16, 17, 18, 20, 21, 24, 25 and 26.

(H-4) Results of Measurement-4: Effects of Solubilizing Agent:

As described above, it is assumed that if the content of the solubilizing agent is too high, it gives adverse influences on the mold-releasing property in the casting process. On the other hand, if the content of solubilizing agent is too low, it becomes impossible to solubilize water in an oil type release agent. Therefore, it is required to optimize the quantity of solubilizing agent.

First of all, the lower limit of solubilizing agent will be explained.

In the case of using the solubilizing agent D-212 which was constituted by a single component, when 0.2% by mass of water was mixed in the release agent as shown in Example 5 (solubilizing agent: 0.8% by mass) of Table 3, the resultant release agent was high in electric resistance and unstable, though the appearance thereof was clear. Therefore, this mixing ratio was assumed as being the approximate lower limit of the single component type solubilizing agent.

TABLE 8

| Parameters | Air pressure (MPa) | Spraying distance (mm) | Temp. of iron plate (° C.) | Electrification | Quantity of adhesion (mg) | Frictional force (kgf) |
|---|---|---|---|---|---|---|
| Ex. 6 | 0.2 | 150 | 150 | Yes | 27.5 | 5 |
| Comp. Ex. 3 | 0.2 | 150 | 150 | No | 18.6 | 3 |
| Ex. 7 | 0.2 | 200 | 250 | Yes | 27 | 3 |
| Comp. Ex. 4 | 0.2 | 200 | 250 | No | 15.8 | 3 |
| Ex. 8 | 0.2 | 250 | 350 | Yes | 16.1 | 7 |
| Comp. Ex. 5 | 0.2 | 250 | 350 | No | 8.7 | 4 |
| Ex. 9 | 0.3 | 150 | 250 | Yes | 27.1 | 2 |
| Comp. Ex. 6 | 0.3 | 150 | 250 | No | 18.7 | 3 |
| Ex. 10 | 0.3 | 200 | 350 | Yes | 19.4 | 5 |
| Comp. Ex. 7 | 0.3 | 200 | 350 | No | 8.3 | 4 |
| Ex. 11 | 0.3 | 250 | 150 | Yes | 19.1 | 3 |
| Comp. Ex. 8 | 0.3 | 250 | 150 | No | 9.6 | 3 |
| Ex. 12 | 0.4 | 150 | 350 | Yes | 19.6 | 5 |
| Comp. Ex. 9 | 0.4 | 150 | 350 | No | 14.8 | 3 |
| Ex. 13 | 0.4 | 200 | 150 | Yes | 18.1 | 5 |
| Comp. Ex. 10 | 0.4 | 200 | 150 | No | 14.6 | 3 |
| Ex. 14 | 0.4 | 250 | 250 | Yes | 14 | 3 |
| Comp. Ex. 11 | 0.4 | 250 | 250 | No | 9.6 | 3 |

Although the quantity of increase in adhesion varied depending on the conditions, the quantity of adhesion increased by about 60% based on arithmetical mean. Therefore, the effects of electrostatic spraying were apparently recognized. It is considered that a soldering problem gradually increases when the friction force exceeds 10 Kgf in the friction test, while a releasing performance is good when the friction force is below 10 Kgf. The effects of static electrification with this friction tester were found to be "no difference" as seen from Table 8. Namely, it can be said that although the magnitude of adhesion was increased, but any further improvement of mold-releasing properties could not be realized since the level of friction was already secured in a sufficient degree.

Incidentally, in the case of the release agent composition of Example 4, where the electric resistance was as high as 200 MΩ, it was possible to derive the electrostatic effects. In view of this fact, it was assumed that there existed "an optimum electric resistance for the electrostatic spray" for the release agent, which electric resistance was different from that of paints. As seen from above Table 4, even in the case of New Kalgen 140, the quantity of adhesion was found high in However, in the case of the mixture type solubilizing agent, i.e. New Kalgen 140, the lower limit is lower than the aforementioned value. The release agent of Example 16 (solubilizing agent: 0.4% by mass and water: 0.1% by mass) in Tables 4 and 5 was transparent in appearance. On the other hand, the release agent of Comparative Example 14 (solubilizing agent: 0.23% by mass and water: 0.1% by mass) was hazy in appearance, thus indicating the insufficient capability thereof to solubilize water therein. Therefore, it is assumed that the lower limit of the solubilizing agent would be nearly 0.3% by mass. Moreover, the electric resistance of the release agent of Example 16 was infinite. Accordingly, in order to confirm the electrostatic effects, the adhesion test was performed. As a result, the increase in quantity of adhesion was 4.1 mg, which was almost the same level as the adhesion-increasing effect of the release agents of Example 17 (solubilizing agent: 1% by mass) and Example 18 (solubilizing agent: 1.6% by mass) (i.e. 3.7 mg and 4.5 mg, respectively), both containing more quantity of solubilizing agent. It can be said that even in the case of Example 16 where the level of the solubilizing agent was relatively low, it was possible to recognize the electrostatic effects. As a result of a study made with respect to the level of solubilizing agents in Examples 17 and 18, it was determined that the lower limit of the solubilizing agent should be 0.3% by mass.

Next, the upper limit of the solubilizing agent will be explained.

In the case where the solubilizing agent D-212 which was constituted by a single component was formulated, although the release agent of Example 3 (solubilizing agent: 4.0% by mass) of Table 3 was transparent in appearance, the release agent of Example 2 (solubilizing agent: 4.8% by mass) was somewhat hazy in appearance. Therefore, this mixing ratio was assumed as being the approximate upper limit of the single component type solubilizing agent.

In the case of the mixture type solubilizing agent, i.e. New Kalgen 140, as seen from Tables 4 and 5, the appearance of even the release agents of Example 21 (solubilizing agent: 5% by mass), Example 24 (solubilizing agent: 10% by mass) and Example 26 (solubilizing agent: 30% by mass, water: 7.5% by mass) was transparent. However, the emulsification was observed in the release agent of Comparative Example 16 (solubilizing agent: 30% by mass, water: 12.9% by mass). As shown in Tables 4 and 5, when the quantity of solubilizing agent was increased, the electric resistance was caused to decrease in conformity with the increase in water content, resulting in increase in quantity of adhesion. In view of these facts, the upper limit of the solubilizing agent was set to 30%.

(H-5) Results of Measurement-5: Summary

As seen from Example 21, when only the solubilizing agent was mixed with the oil type release agent at a ratio of 5%, it was possible to realize the electrostatic effects. Namely, the incorporation of water was not necessarily required. However, when water was blended, it was possible to remarkably decrease the electric resistance, thereby facilitating the electrostatic spraying. However, in order to enable a large quantity of water to be mixed with the oil type release agent, the quantity of the solubilizing agent was required to be increased. As explained above, water should be incorporated in the range of 0-7.5% by mass and the solubilizing agent should be incorporated in the range of 0.3-30% by mass. As a result of this, it is possible to realize the electrostatic effects and to increase the amount of adhesion.

Incidentally, when water is incorporated at a concentration falling outside the aforementioned range, various problems regarding the quality of the oil type release agent would be raised. For example, if the quantity of water is too much, the emulsification of oil type release agent would be generated, thus possibly causing the separation of water. When the leakage of oil is caused to occur during the operation, the releasing agent that has been emulsified may be permitted to flow into a drainage ditch, thus raising the problem of emulsification. Furthermore, once this emulsification occurs, the viscosity of the releasing agent would become too high, thus making it difficult to apply uniform spraying. Additionally, the lowering of Leidenfrost's temperature may be caused to occur, giving rise to the generation of bumping of water, thereby increasing the possibility of raising the problem with regard to releasing properties due to the sudden lowering in amount of adhesion.

Even when the content of the solubilizing agent is too high, there is the possibility of raising the problem with regard to releasing properties of casting products. When the concentration of the solubilizing agent becomes higher, the quantity of adhesion owing to electrostatic effects would be increased (see Examples 20, 21, 24, 25, 26 and Comparative Example 16). Namely, it was assumed that, since the solubilizing agent having chemical bonds such as ester, ether, etc., was enabled, through the polarity thereof, to adsorb onto iron at a large quantity, the quality of adhesion was increased. Although the solubilizing agent is excellent in enhancing the adhesion efficiency, the decomposition-initiating temperature thereof is around 250° C., so that there is a high possibility that it may give rise to the problem of porosity in casting products. Therefore, it is important that the mixing ratio of the solubilizing agent should be optimized taking into account the adhesion efficiency to be derived from other kinds of lubricating oil components.

Incidentally, although the problems raised in an actual apparatus may vary depending on the size and operating conditions of the apparatus, the mixing ratio of water and the solubilizing agent should preferably be confined to 0.2-1.2% by mass for water and to 0.8-4.8% by mass for the solubilizing agent in order to minimize the problems as much as possible.

Next, the effects of electrostatic spray were investigated by making use of an oil type release agent composition which could be statically electrified and by means of an electrostatic spray gun mounted on a multi-axle robot, though this assessment based on an actual apparatus was not enable to be digitalized. Under the condition where the electrostatic spray was not applied, the spraying of the red-colored release agent of Example 4 was applied. As a result, only a weak red color could be visually recognized at the innermost portion of the mold, thus indicating the existence of a portion which was low in adhesion of the release agent. On the other hand, when the spraying was performed under the condition where the electrostatic spray was applied, a significant color change was observed, thus recognizing the adhesion of a large quantity of the components of release agent.

The setting of conditions where the electrostatic spray existed is more advantageous in increasing the magnitude of adhesion of the release agent at the innermost portion or fine portion of the mold and hence it is expected that the setting of such conditions would bring about the effects of decreasing the soldering occurrence during the casting. Namely, it is possible to expect the effect of wraparound-effect which is characteristic of electrostatic spray. It is also expected that this characteristic leads to a further saving in quantity of spraying.

On the other hand, in the case where the electrostatic spraying is not applied, it may be necessary to increase the quantity of spray in order to secure a suitable oil film even at a portion to which oil droplets can hardly reach. Moreover, there is a high possibility that the portions of the mold which are exposed frontward would be covered with excessive quantity of spray. In the case where the electrostatic spraying is applied, however, this redundant portion of spray can be saved. Namely, electrostatic spraying is not only effective in contributing to the economy of makers of casting products but also in contributing to the improvement of the working environment.

The oil type lubricating release agent of the present invention is suited for electrostatic spraying on the occasion of casting non-ferrous metals and for the lubrication of the inner surface of molds. Incidentally, it should not be construed that the present invention is limited by the aforementioned examples but should be understood that the present invention can be variously modified in the practical application thereof without departing from the scope of the general inventive concept as defined by the appended claims. Further, a plurality of constituent elements disclosed in these examples may be optionally combined to create various forms of invention. For example, some of constituent elements may be omitted from the entire constituent elements disclosed in these embodiments. Furthermore, the constituent elements described in different examples may be optionally combined.

What is claimed is:

1. A release composition for metal casting, comprising:

0.2-7.5% by weight of the total composition of water consisting of one or two kinds of water selected from distilled water, ion-exchanged water, tap water and water comprising any one of the aforementioned kinds of water and electrolyte(s) dissolved therein;

0.3-30% by weight of the total composition of a solubilizing agent; and an oil type release agent, constituting the rest of the composition, wherein the oil type release agent is WFR-3R and including:

(a) about 89 parts by weight of a solvent having dynamic viscosity of 2 to 10 $mm^2/s$ at 40° C. and a flash point in the range of 70 to 170° C., (b) about 5 parts by weight of a high viscosity mineral oil and/or synthetic oil having dynamic viscosity of 100 $mm^2/s$ or higher at 40° C., (c) about 5 parts by weight of a silicone oil having dynamic viscosity of 150 $mm^2/s$ or higher at 40° C., (d) about 0.5 parts by weight of a rapeseed oil; and (e) about 0.5 parts by weight of organic molybdenum, wherein the oil type release agent has a flash point in the range of 70 to 170° C. and dynamic viscosity of 2 to 30 $mm^2/s$ or higher at 40° C.

2. The composition according to claim 1, wherein the water is contained at a ratio of 0.3% to 1.2% by weight and the solubilizing agent is contained at a ratio of 0.8-4.8% by weight.

3. The composition according to claim 1, which is electrostatically sprayable.

4. The composition according to claim 1, wherein the water is present in an amount of 0.2% to 1.2% by weight.

5. The composition according to claim 1, wherein the water comprises only one of aforementioned kinds of water and electrolyte(s) dissolved therein.

* * * * *